United States Patent [19]

Hiraoka et al.

[11] Patent Number: 4,697,071

[45] Date of Patent: Sep. 29, 1987

[54] CIRCULATION TYPE AUTOMATIC MONEY RECEIVING AND PAYING MACHINE WITH NOTE SIDE IDENTIFYING AND NOTE TURNING-OVER SECTIONS

[75] Inventors: Shigeaki Hiraoka; Takamasa Seo, both of Himeji, Japan

[73] Assignee: Glory Kogyo Kabushiki Kaisha, Himeji, Japan

[21] Appl. No.: 906,674

[22] Filed: Sep. 10, 1986

Related U.S. Application Data

[63] Continuation of Ser. No. 596,350, Apr. 3, 1984, abandoned.

[30] Foreign Application Priority Data

Nov. 29, 1983 [JP] Japan ..... 58-225163

[51] Int. Cl.[4] ..... B07C 5/00; B65H 29/00; B65H 29/40

[52] U.S. Cl. ..... 235/379; 209/534

[58] Field of Search ..... 235/379; 364/405, 408; 209/534; 271/291, 3.1, 4, 9

[56] References Cited

U.S. PATENT DOCUMENTS

| | | | |
|---|---|---|---|
| 3,930,581 | 1/1976 | Gray | 209/534 |
| 4,365,700 | 12/1982 | Arimoto et al. | 194/2 |
| 4,398,088 | 8/1983 | Hirose et al. | 235/379 |
| 4,465,192 | 8/1984 | Ohba et al. | 209/534 |
| 4,479,049 | 10/1984 | Hirose | 235/379 |
| 4,510,380 | 4/1985 | Uchida et al. | 235/379 |
| 4,542,829 | 9/1985 | Emery et al. | 209/534 |

FOREIGN PATENT DOCUMENTS

| | | | |
|---|---|---|---|
| 0051598 | 4/1979 | Japan | 209/534 |

*Primary Examiner*—Jerry Smith
*Assistant Examiner*—Clark A. Jablon
*Attorney, Agent, or Firm*—Beveridge, DeGrandi & Weilacher

[57] ABSTRACT

In a circulation type automatic money receiving and paying machine, the paying-in note conveying path and the paying-out note conveying path has a common conveying path, and a mechanism for identifying the face or back sides of notes and a mechanism for turning over a note are arranged along the common conveying path, so that the bank notes are dispensed with the face or back sides thereof faced in the same direction at all times.

1 Claim, 20 Drawing Figures

FIG. 6(a)

| | | |
|---|---|---|
| PAYING-IN MONEY AMOUNT MEMORY | | NKM |
| PAYING-IN NUMBER-OF-NOTES MEMORY | 10,000 | 10,000 NMM |
| | 5,000 | 5,000 NMM |
| | 1,000 | 1,000 NMM |
| PAYING-IN MONETARY SUM MEMORY | | GKM |
| PAYING-IN COUNT MEMORY | 10,000 | 10,000 KMM |
| | 5,000 | 5,000 KMM |
| | 1,000 | 1,000 KMM |
| PAYING-OUT MONEY AMOUNT MEMORY | | SKM |
| PAYING-OUT NUMBER-OF-NOTES MEMORY | 10,000 | 10,000 SMM |
| | 5,000 | 5,000 SMM |
| | 1,000 | 1,000 SMM |
| NUMBER-OF-NOTES-TAKEN-OUT MEMORY | | TMM |

FIG. 6(b)

| | | |
|---|---|---|
| TAKING-OUT DENOMINATION FLAG | 10,000 | MFL |
| | 5,000 | GFL |
| | 1,000 | SFL |

CIRCULATION TYPE AUTOMATIC MONEY RECEIVING AND PAYING MACHINE WITH NOTE SIDE IDENTIFYING AND NOTE TURNING-OVER SECTIONS

This application is a continuation of application Ser. No. 596,350, filed Apr. 3, 1984, now abandoned.

BACKGROUND OF THE INVENTION

This invention relates to a circulation type automatic money receiving and paying machine in which paying-in bank notes inserted thereinto are received and are dispensed as paying-out bank notes.

In a recent circulation type automatic money receiving and paying machine, it is often required that in dispensing paying-out bank notes they are so arranged that their face or back sides face in the same direction. In order to meet this requirement, a circulation type automatic money receiving and paying machine having a mechanism for causing the face or back sides of bank notes to face in the same direction along its note conveying path, has been proposed in the art.

However, since the mechanism is arranged in the paying-in bank note conveying path or in the paying-out bank note conveying path, the conventional machine suffers from the following difficulties:

The machine having the mechanism only in the paying-in bank note conveying path is advantageous in that, when paying-in bank notes are dispensed as paying-out bank notes, their face or back sides are caused to face in the same direction. However, when it is required for the teller to supplement the notes in the note accommodating section, he must use a note arranging machine or the like to arrange the bank notes in such a manner that their face or back sides face in the same direction. This work is extremely troublesome for a bank which has no note arranging machine. In addition, sometimes the teller may load the bank notes upside down.

On the other hand, the machine having the mechanism only in the paying-out bank note conveying path is advantageous in that paying-out bank notes are dispensed with the face or back sides faced in the same direction. However, when the teller collects the notes from the note accommodating section, the face or back sides are not always faced in the same direction, and therefore he must arrange them by using a note arranging machine or the like. This will give a heavy burden to the teller when the bank is closed. This tendency is significant in the bank which has no note arranging machine.

Accordingly, a bank has the circulation type automatic money receiving and paying machine with the mechanism for causing the face or back sides of notes to face in the same direction in the paying-in bank note conveying path and/or the machine with the mechanism in the paying-out bank note conveying path depending on the situation.

SUMMARY OF THE INVENTION

Accordingly, an object of this invention is to overcome the above-described difficulties accompanying a conventional circulation type automatic money receiving and paying machine.

More specifically, an object of the invention is to provide a circulation type automatic money receiving and paying machine in which bank notes to be recieved in its paying-in note accommodating section and bank notes to be dispensed as paying-out bank notes are arranged in such a manner that their face or back sides face in the same direction.

The foregoing object and other objects of the invention have been achieved by the provision of a circulation type automatic money receiving and paying machine in which paying-in bank notes inserted thereinto are received and are dispensed as paying-out bank notes, which, according to the invention, comprises: a paying-in bank note conveying path and a paying-out bank note conveying path which include a common conveying path; note identifying means for identifying at least the face and back sides of bank notes; and note turning-over means for turning over a bank note according to the result of identification made by the note identifying means, the note identifying means and the note turning-over means being arranged along the common conveying path, so that bank notes are dispensed as paying-out bank notes with the face or back sides thereof faced in a predetermined direction.

The nature, principle and utility of the invention will become more apparent from the following detailed description when read in conjunction with the accompanying drawings, in which like parts are designated by like reference numerals or characters.

BRIEF DESCRIPTION OF THE DRAWINGS

In the accompanying drawings

FIGS. 6(*a*) and 6(*b*) are explanatory diagrams showing contents stored in a RAM in FIG. 2.

DETAILED DESCRIPTION OF THE INVENTION

Figure 1:
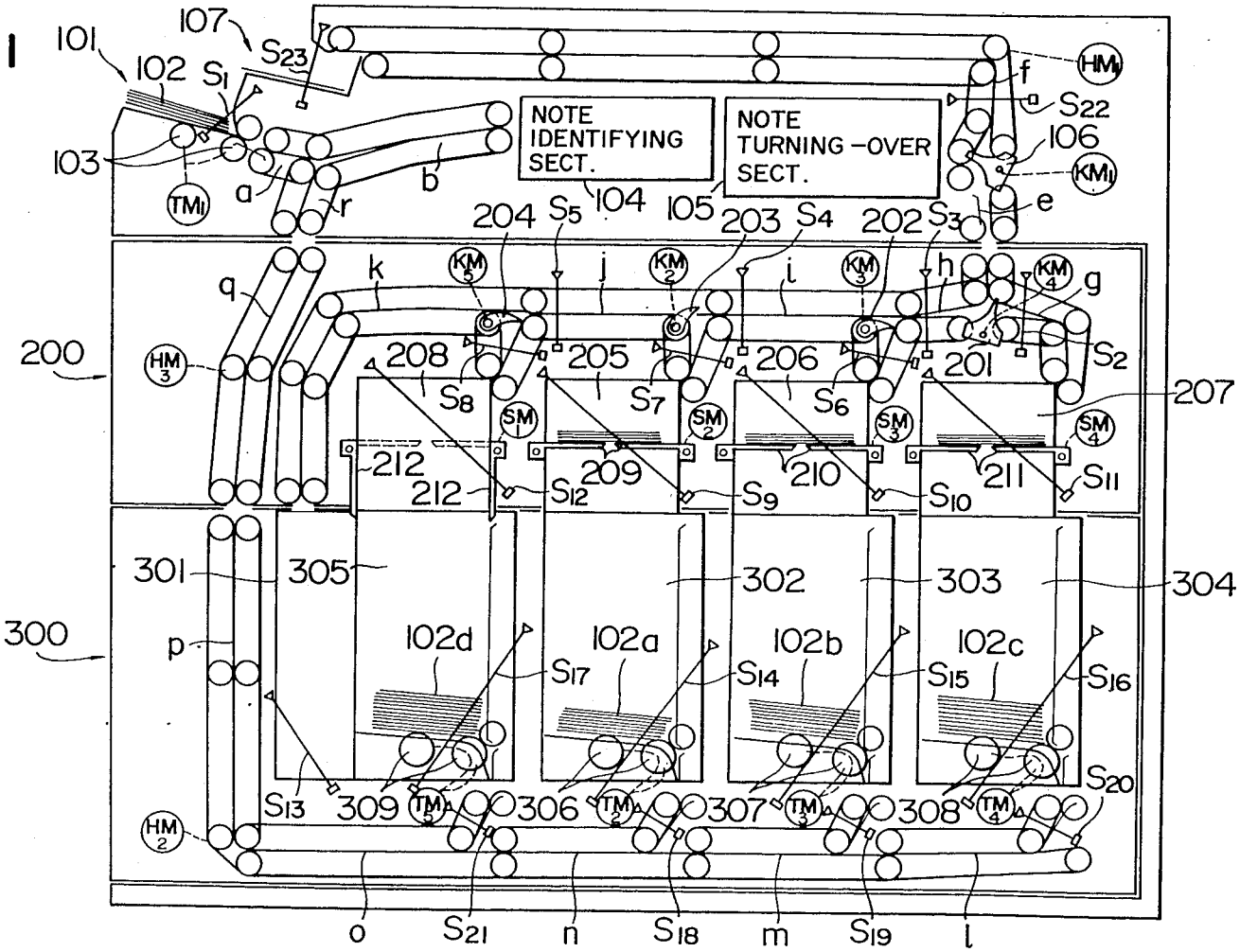
FIG. 1 is an explanatory diagram showing the internal arrangement of one example of a circulation type automatic money receiving and paying machine according to this invention.

Several embodiments of the invention will be described with reference to the accompanying drawings in which like parts are designated by like reference numerals or characters.

FIG. 1 shows the internal arrangement of one example of a circulation type automatic money receiving and paying machine according to the invention. The machine is used by a teller in a bank. The machine is electrically connected to a teller's terminal machine so that it is operated according to instructions from the teller's terminal machine operated by the teller.

The circulation type automatic money receiving and paying machine, as shown in FIG. 1, comprises: a body 100 for inserting bank notes, identifying them, turning them over and paying or returning them; a temporary holding unit 200 for temporarily holding bank notes separately according to the monetary denominations; and an accommodating unit 300 for accommodating bank notes inserted in such a manner that the bank notes can be paid or returned.

Paying-in bank notes 102 inserted through a bank note inserting opening 101 are taken into the machine one after another by a note taking-in or accepting mechanism 103 driven by a pulse motor $TM_1$ and are then delivered through conveying paths a and b to a note identifying section 104. In general, the paying-in bank notes thus inserted include bank notes different in monetary denomination and bank notes damaged. Therefore, in the bank note identifying section 104, it is detected whether or not the bank note received is a true one, it is detected whether or not it is damaged, it is detected whether or not it is laid obliquely, or it is detected whether or not a plurality of bank notes are overlapped, and furthermore the monetary denomination, the face and back sides and the thickness of the bank note are detected (high class identification). The paying-in note passed through the note identifying section 104 is delivered to a note turning-over section 105, in which the note whose back side faces upwardly is turned over. Thus, all the notes, are delivered out of the note turning-over section 105 after their face sides have been faced upwardly. The construction of the note turning-over section 105 will be described later.

When notes are inserted into the machine, a lever 106 is directed upwardly by a pulse motor $KM_1$, and therefore a bank note delivered out of the note turning-over section 105 is sent through a conveying path e to the temporary holding unit 200. In the case where a paying-in note is a false note, or abnormal in thickness, or delivered obliquely, or a plurality of notes are overlapped, the lever is directed downwardly to return the note or notes. Levers 201, 202, 203 and 204 driven by pulse motors $KM_4$, $KM_3$, $KM_2$ and $KM_5$ switch conveying paths according to the results of identification provided by the note identifying section 104. The timing of switching the conveying paths occurs when the front edge of a bank note is detected by sensors $S_3$, $S_4$ and $S_5$, and the timing of restoration occurs when the rear edge of the bank note is detected by sensors $S_2$, $S_6$, $S_7$ and $S_8$. Thus, for instance, "10,000-yen" bank notes are delivered through conveying paths h and i to a first temporary holding section 205, "5,000-yen" bank notes are delivered through the conveying path h to a second temporary holding section 206, "1,000-yen" bank notes are delivered through a conveying path g to a third temporary holding section 207, and bank notes to be collected such as "500-yen" bank notes (which are changed for coins) and bank notes damaged are delivered through the conveying paths h, i and j to a temporary holding section 208 for rejecting those notes. A note which has been determined as a damaged bank note by the note identifying section 104 is sent through the conveying paths h, i, j and k to a reject section 301. Sensors $S_9$, $S_{10}$, $S_{11}$ and $S_{12}$ detect the presence or absence of notes in the temporary holding sections 205, 206, 207 and 208, respectively. When pulse motors $SM_2$, $SM_3$, $SM_4$ and $SM_1$ open holding pieces 209, 210, 211 and 212, respectively, the notes are put in first, second and third accommodating cassette sections 302, 303 and 304 and a rejecting cassette section 305 separately according to the monetary denominations.

Sensors $S_{13}$, $S_{14}$, $S_{15}$, $S_{16}$ and $S_{17}$ detect the presence or absence of bank notes in the rejecting section 301, the first, second and third accommodating cassette sections 302, 303 and 304 and the rejecting cassette section 305, respectively. The first, second and third accommodating cassette sections 302, 303 and 304 and the rejecting cassette section 305 can be pulled, as one unit, out of the body 100. The teller can take the notes 102*a*, 102*b*, 102*c* and 102*d* out of the cassettes separately to collect them.

In paying bank notes, the bank notes are taken out one after another by note taking-out or releasing mechanisms 306, 307, 308 and 309 which are driven by pulse-motors $TM_2$, $TM_3$, $TM_4$ and $TM_5$, respectively. The bank notes thus taken out are sent through conveying paths l, m, n, o, p, q, r and b to the note identifying section 104. In the section 104, it is detected whether or not each bank note has its face directed upwardly, it is detected whether or not it is laid obliquely or it is detected whether or not notes are overlapped, and furthermore the monetary denomination and the thickness of each bank note are detected (low class identification). When the back side of the note faces upwardly, it is turned over by the note turning-over section 105 and is then returned through a conveying path f to a note returning opening 107. In FIG. 1, a sensor $S_{22}$ is provided for detecting the timing of restoration of the lever 106, and a sensor $S_{23}$ is provided for detecting the paying of a bank note. Sensors $S_{18}$ through $S_{21}$ detect when the bank notes 102*a* through 102*d* are taken out of the cassette sections, respectively (being utilized for counting the numbers of bank notes taken out). Motors $HM_1$, $HM_2$ and $HM_3$ are provided for driving the conveying paths.

When the teller supplements the bank notes, he may pull out the accommodating unit 300 to directly put the bank notes in the cassette sections 302 through 304, or he may use the note inserting opening 101. In the latter case, after being subjected to the low class identification by the note identifying section 104, the notes are delivered into the accommodating cassette sections 302 through 304.

Figure 2:
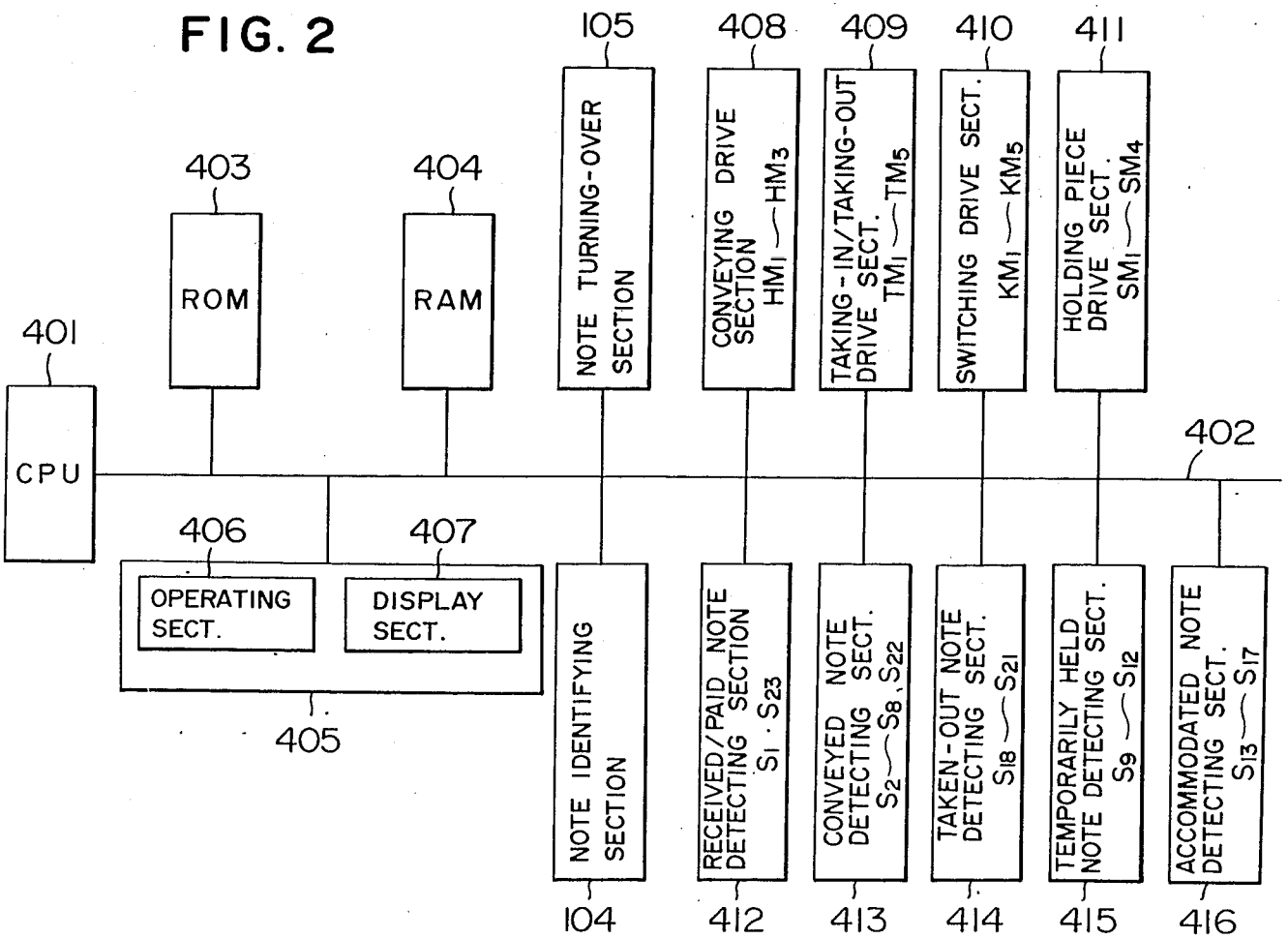
FIG. 2 is a block diagram showing a control mechanism in the machine in FIG. 1.

FIG. 2 is a block diagram showing a control mechanism for the machine shown in FIG. 1. As shown in FIG. 2, a CPU 401 is connected through a bus line 402 to the note identifying section 104, the note turning-over section 105, a ROM 403, a RAM 404 and a teller's terminal machine 405. Programs for operating the CPU 401 have been stored in the ROM 403. Data such as an amount of money and a number of sheets are written in or read out of the RAM 404. The teller's machine 405 comprises: an operating section 406 such as a key board operated by the teller; and a display section 407.

The CPU 401 is further connected through the bus line 402 to a drive mechanism which includes: a conveying drive section 408 consisting of the motors $HM_1$ through $HM_3$; a taking-in/taking-out drive section 409 consisting of the pulse motors $TM_1$ through $TM_5$; a switching drive section 410 consisting of the pulse motors $KM_1$ through $KM_5$; and a holding piece drive section 411 consisting of the pulse motors $SM_1$ through $SM_4$. In addition, the CPU 401 is coupled through the bus line 402 to a received/paid note detecting section 412 consisting of the sensors $S_1$ and $S_{23}$, a conveyed note detecting section 413 consisting of the sensor $S_2$ through $S_8$ and $S_{22}$, a taken-out note detecting section 414 consisting of the sensors $S_{18}$ through $S_{21}$, a temporarily held note detecting section 415 consisting of the sensors $S_9$ through $S_{12}$ and an accommodated note detecting section 416 consisting of the sensors $S_{13}$ through $S_{17}$.

Figure 3:
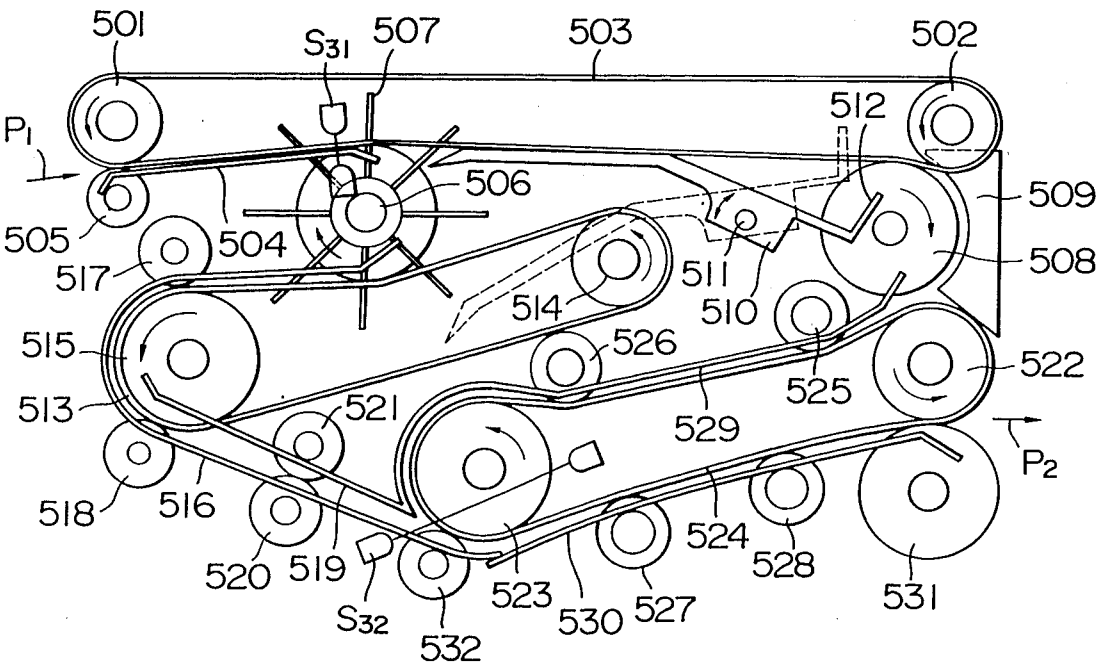
FIG. 3 is an explanatory diagram showing a note turning-over section in the machine in FIG. 1 in detail.
Figure 4A:
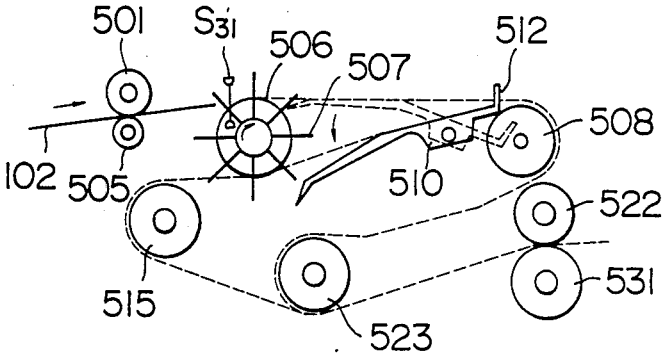
FIGS. 4(*a*)–4(*f*) and FIGS. 5(*a*)–5(*d*) are explanatory diagrams for a description of the operation of the note turning-over section in FIG. 3.
Figure 4B:
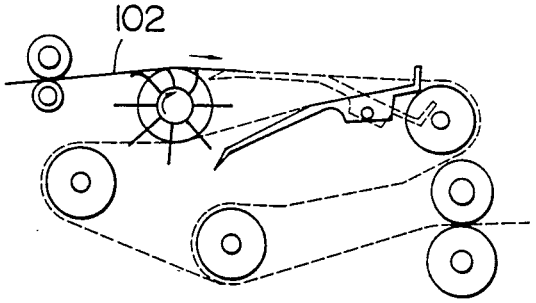
Figure 4C:
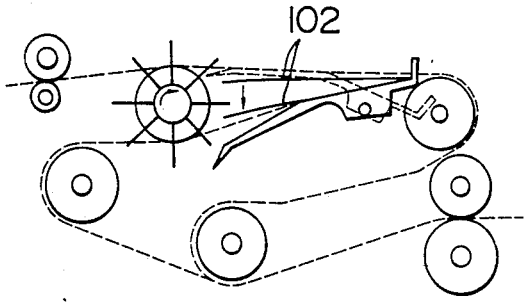
Figure 4D:
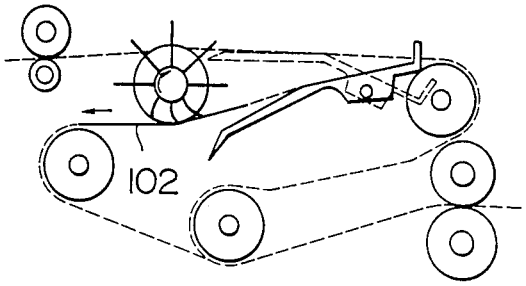
Figure 4E:
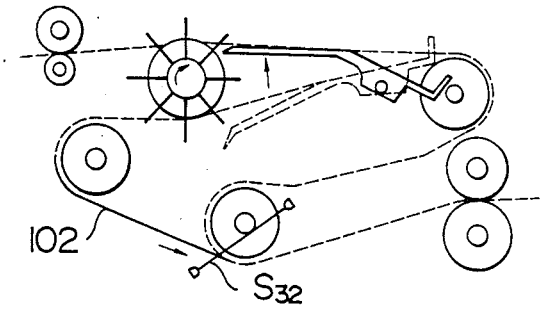
Figure 4F:
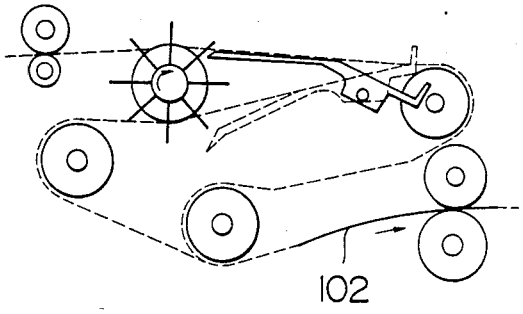
Figure 5A:
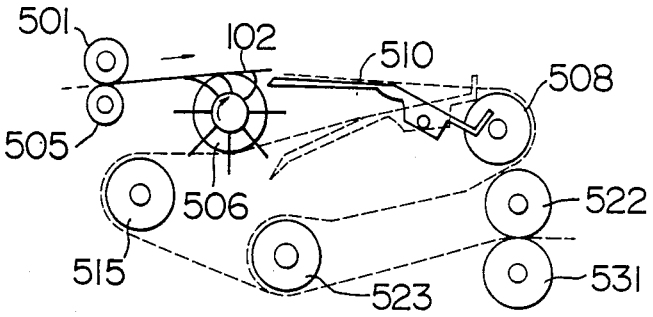
Figure 5B:
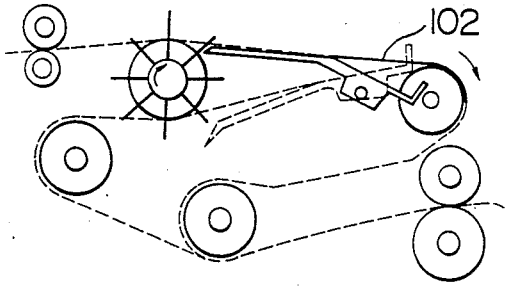
Figure 5C:
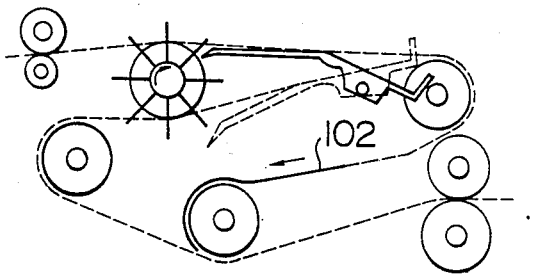
Figure 5D:
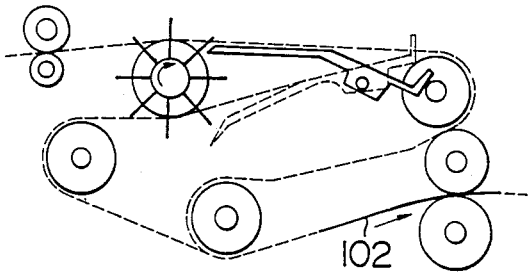

FIG. 3 shows the construction of the note turning-over section 105 in detail. As shown in FIG. 3, an endless belt 503 is laid over main rollers 501 and 502 under tension. On the note loading side of the endless belt 503, a guide plate 504 is provided near the lower surface of the belt 503, so that a note conveying path is formed between the guide plate and the lower surface of the belt 503. On the inlet side of the note conveying path, an auxiliary roller 505 is provided for the main roller 501. On the outlet side of the note conveying path, a sensor $S_{31}$ and a roller 506 are provided. The roller 506 has vanes 507 of elastic material (such as rubber) which are extended radially. The upper surface of the roller 506 is in contact with the lower surface of the endless belt 503. An auxiliary roller 508 abutting against the lower surface of the endless belt 503 and a guide member 509 are provided on the side of the main roller 502. The guide member 509 and the auxiliary roller 508 form a conveying path. A direction changing board 510 for changing the direction of conveyance of a note is provided between the roller 506 and the auxiliary roller 508. The board 510 can be turned about the shaft 511 in the directions of the arrows by a solenoid (not shown) or the like, and it has a stopper 512 at the rear end.

An endless belt 513 is laid on main rollers 514 and 515 below the roller 506 with the vanes 507 in such a manner that the roller 506 abuts against the upper surface of the endless belt 513. On the side of the main roller 515, a guide board 516 is provided near the outside of the endless belt 513 so that the guide board 516 and the endless belt form a conveying path. Auxiliary rollers 517 and 518 are disposed along the conveying path thus formed. The conveying path is extended obliquely downwardly with the aid of a guide board 519 confronted with the guide board 516 and a pair of auxiliary rollers 520 and 521 provided along these guide boards.

A main roller 522 is disposed below the auxiliary roller 508, and another main roller 523 is provided at the lower portion of the device. An endless belt 524 is laid over these main rollers 522 and 523. Auxiliary rollers 525 and 526 abut against the upper side of the endless belt 524, while auxiliary rollers 527 and 528 abut against the lower side of the belt 524. A guide board 529 is provided near the upper side of the endless belt 524, while guide board 530 is provided near the lower side of the endless belt 524. Auxiliary rollers 531 and 532 are provided below the main rollers 522 and 523, respectively, in such a manner that they are in contact with the endless belt 524. A sensor $S_{32}$ is disposed near the main roller 523.

In FIG. 3, the arrows indicate the directions of rotation of the rollers, and reference character $P_1$ designates the direction in which a bank note is moved into the note turning-over section, and $P_2$ the direction in which a bank note is moved out of the note turning-over section.

Now, an operation of turning over a bank note will be described with reference to FIGS. 4 and 5. When the note identifying section 104 determines that the back side of a note faces upwardly, the note is turned over as indicated by the parts (a) through (f) of FIG. 4. When the section 104 determines that the face side of a note faces upwardly, the note is delivered out as it is as shown in the parts (a) through (d) of FIG. 5. These operations will be described in more detail.

It is assumed that a bank note 102 whose back side faces upwardly is inserted. When the sensor $S_{31}$ detects the front edge of the bank note, the direction changing board 510 is turned counterclockwise, as shown in the part (a) of FIG. 4. Accordingly, the note 102 is conveyed over the roller 506 as shown in the part (b) of FIG. 4, and is then stopped by the stopper 512 as shown in the part (c) of FIG. 4. As a result, the note 102 thus stopped is moved downwardly (as indicated by the arrow) by the vanes 507; that is, the conveying path is switched as shown in the part (d) of FIG. 4. The note 102 passes over the main roller 515. When the note reaches the main roller 523, its front edge is detected by the sensor $S_{32}$, whereupon the direction changing board 510 is restored, as shown in the part (e) of FIG. 4. Thereafter, while being conveyed passing through the rollers 522 and 531 paired, the note is turned over so that its back side faces downwardly.

On the other hand, when it is determined that the face side of a bank note 102 faces upwardly, the direction changing board 510 is not turned. Accordingly, the note inserted as shown in the part (a) of FIG. 5 goes straightly as it is. The note 102 moves along the conveying path outside the auxiliary roller 508 as shown in the part (b) of FIG. 5 and then goes into the conveying path outside the main roller 523 as shown in the part (c) of FIG. 5. Accordingly, while being conveyed passing through the rollers 522 and 531 paired, the face side of the note is maintained faced upwardly.

FIG. 6 shows explanatory diagrams showing the contents of the RAM 404 in FIG. 2. The part (a) of FIG. 6 shows the paying-in and paying-out memories and number-of-sheets (notes) memories provided separately according to the monetary denominations, and the part (b) of FIG. 6 shows taking-out denomination flags. These memories may be incorporated in the teller's terminal machine, or they may be separately provided as necessary.

The operation of the machine thus organized will be described with reference to FIGS. 7, 8 and 9.

Figure 7:
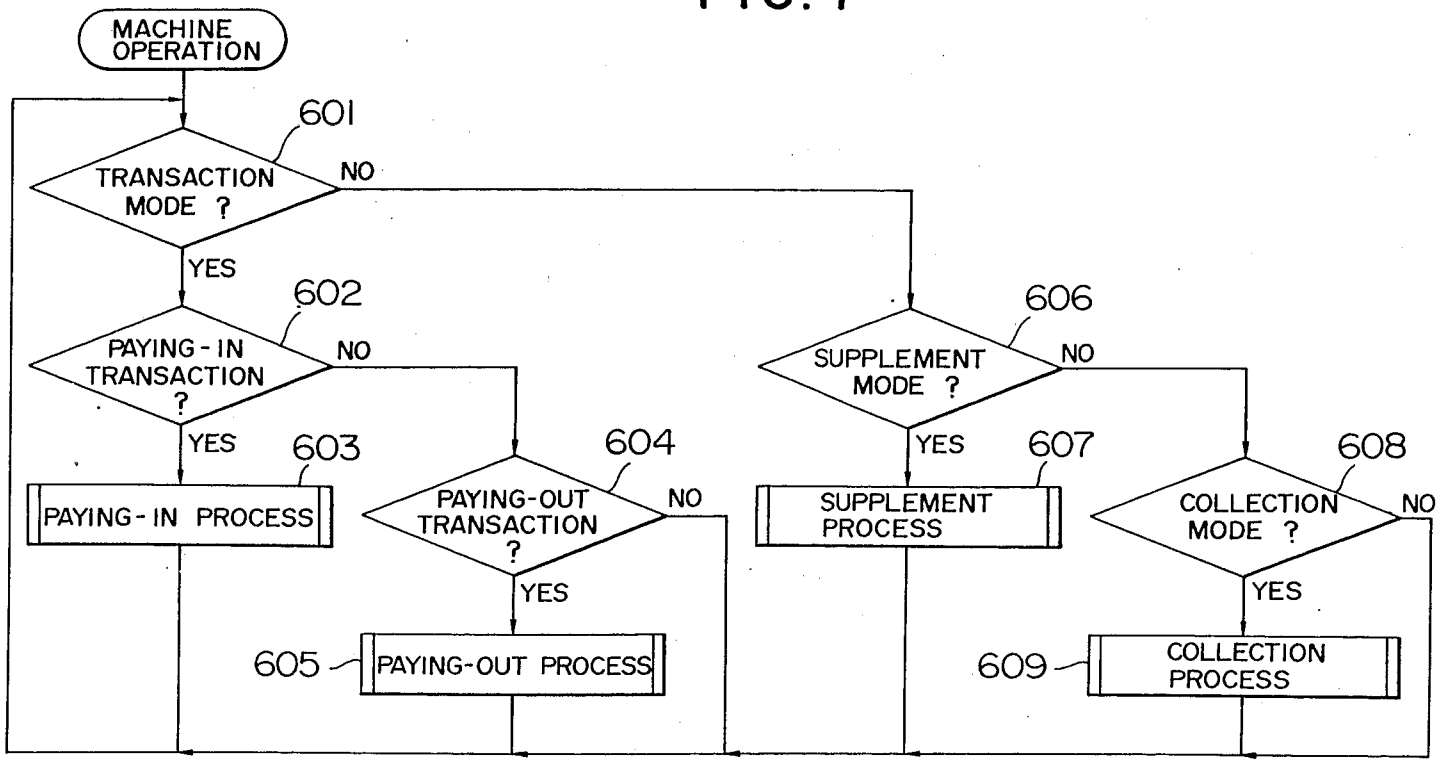

FIG. 7 is a flow chart showing the fundamental operation. When, after the machine has been activated, the operator (or the teller) specifies a transaction mode (Block 601) and a paying-in transaction (Block 602), a paying-in process is carried out (Block 603). When instead of the paying-in transaction a paying-out transaction is specified (Blocks 602 and 604), a paying-out process is carried out (Block 605). When the teller specifies a supplement mode instead of the transaction mode (Blocks 601 and 606), a supplement process is performed (Block 607). When, instead of the supplement mode, a collection mode is specified (Blocks 606 and 608), a collection process is conducted (Block 609).

Figure 8A:
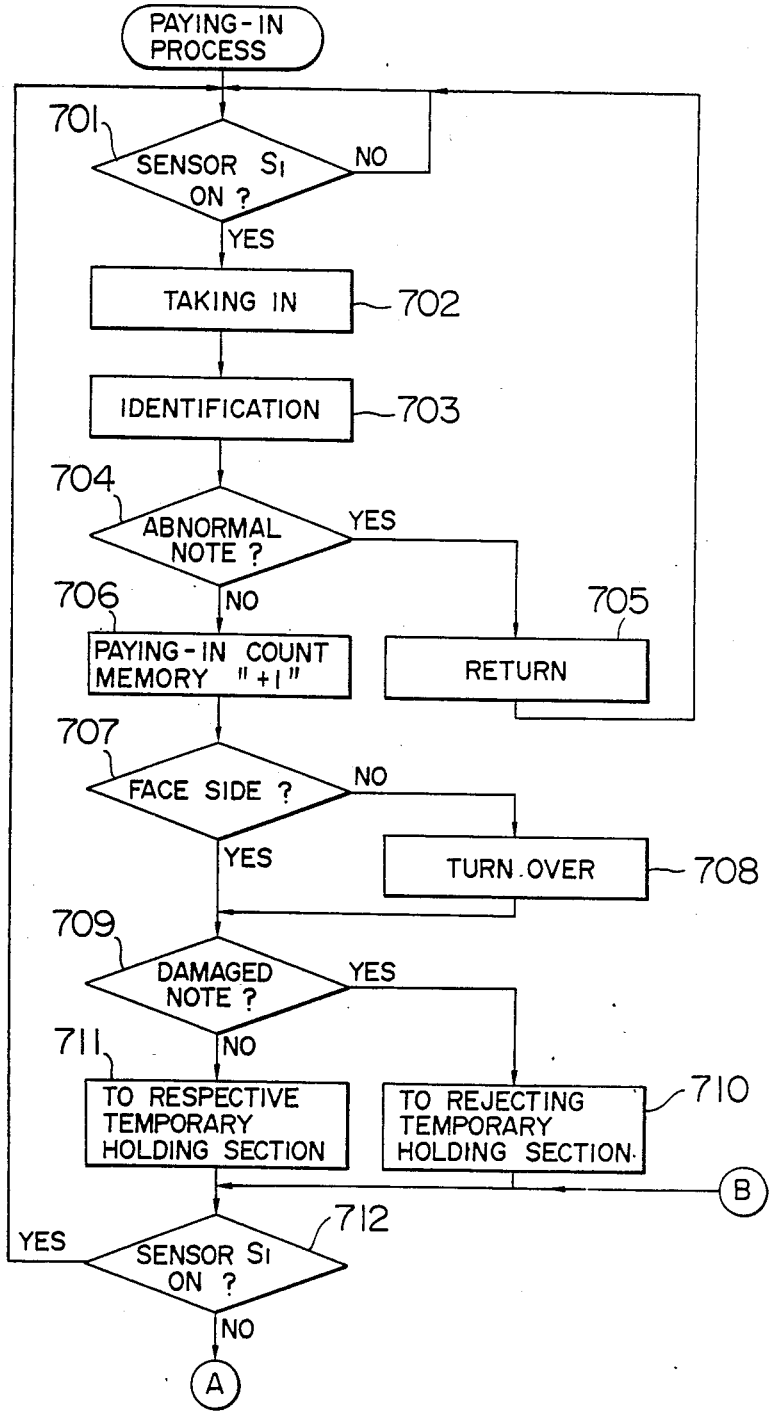
FIGS. 8(*a*), 8(*b*), 9(*a*) and 9(*b*) are flow charts for a description of the operation of the machine according to the invention.
Figure 8B:
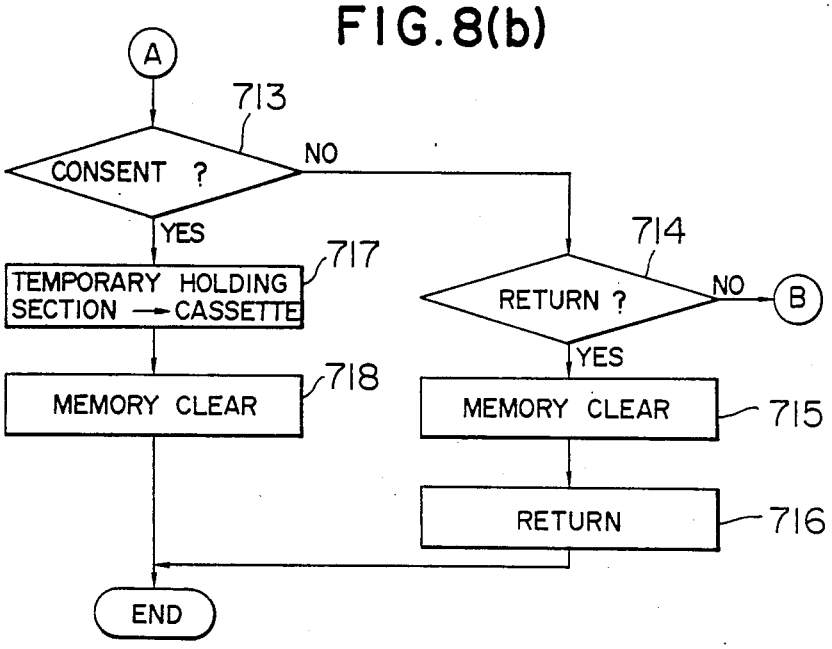

The parts (a) and (b) of FIG. 8 are flow charts for the paying-in process in FIG. 7. When the teller operates the operating section 406 of the teller's terminal machine 405 to input an amount of money to be received (hereinafter referred to as "a paying-in money amount" when applicable), monetary denominations and the number of notes, these data are stored in the paying-in money amount memory NKM or the number-of-notes memories provided separately according to the monetary denominations 10000NMM, 5000NMM and 1000NMM shown in the part (a) of FIG. 6. Under this condition, the notes from the customer are inserted into the note inserting opening 101 by the teller. The insertion of the notes is detected by the sensor $S_1$ (Block 701), and the notes thus inserted are taken into the machine one after another by the taking-in mechanism 103 (Block 702).

Each of the notes thus taken is subjected to the high class identification by the note identifying section 104 (Block 703). If the note has an abnormal thickness, or it is obliquely positioned, or it is a false note, or the notes are overlapped (Block 704), then the lever 106 is operated to send the note or notes to the conveying path f, so that the note or notes are returned through the returning opening 107 (Block 705). When it is determined that the note is normal, one (+1) is added to the content of the respective one of the paying-in count memories 10000KMM, 5000KMM and 1000KMM (Block 706).

When it is detected by the note identifying section 104 that the back side of the note faces upwardly (Block 707), the note is turned over while passing through the note turning-over section 105 (Block 708). When it is detected by the section 104 that the note is a false note (Block 709), it is received by the rejecting temporary holding section 208 because it cannot be used as a paying-out note (Block 710). When the note is normal, it is classified according to the denominations and is received by the respective one of the temporary holding sections 205, 206 and 207 (Block 711).

While the sensor $S_1$ is detecting the next note, the note taking-in operation is continued (Block 712).

After all the notes have been taken into the machine, the teller compares the total of money and the numbers of notes provided separately according to the denominations which are displayed on the display section 407 of the teller's terminal machine 405 with those which have been manually inputted. When the former data are found coincident with the latter data, the teller operates the paying-in key (Block 713).

Even if some of the notes are returned from the machine, and then the data manually inputted are not equal to the data displayed on the display section 407, a consent key is sometimes operated by the mutual consent between the customer and the teller. In this case, the notes returned from the machine are handed to the customer. On the other hand, when it is required to stop the transaction because of the non-coincidence of the data, the return key may be operated to clear the contents of the memories (Blocks 714 and 715). In this case, the teller pulls out the temporary holding unit 200 to hand the notes to the customer (Block 716). In addition, the notes thus returned may be inserted again through an inserting opening 101 and also may be additionally inserted when they are divisionally inserted.

When the consent key is operated, the holding pieces 209 through 212 are operated, as a result of which the notes held in the temporary holding sections 205 through 208 are received by the cassette sections 302 through 305, respectively (Block 717), and the paying-in monetary sum memory GKM and the paying-in count memories 10000KMM, 5000KMM and 1000KMM are cleared (Block 718).

Figure 9B:
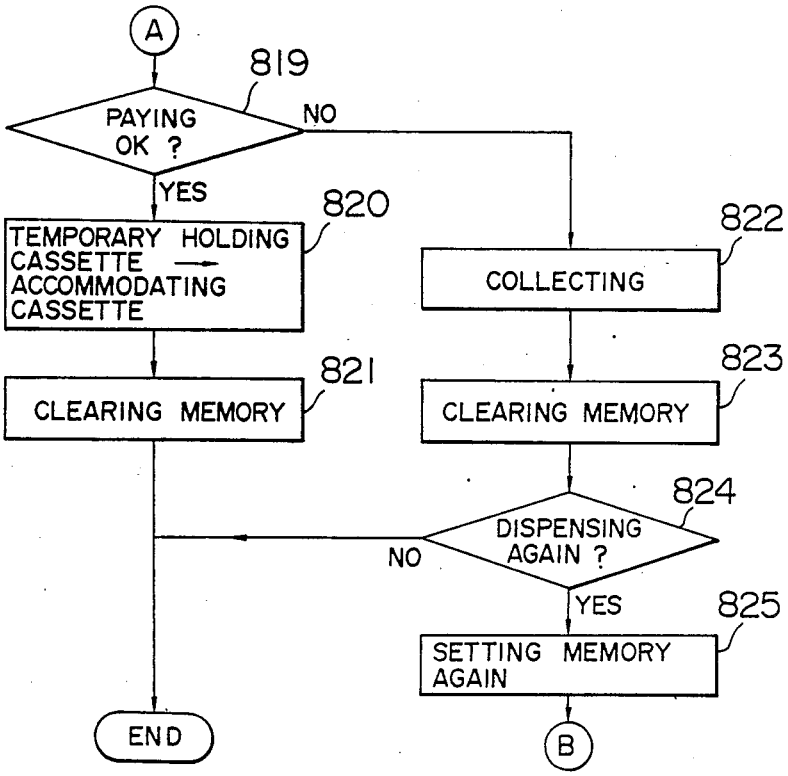
Figure 9A:
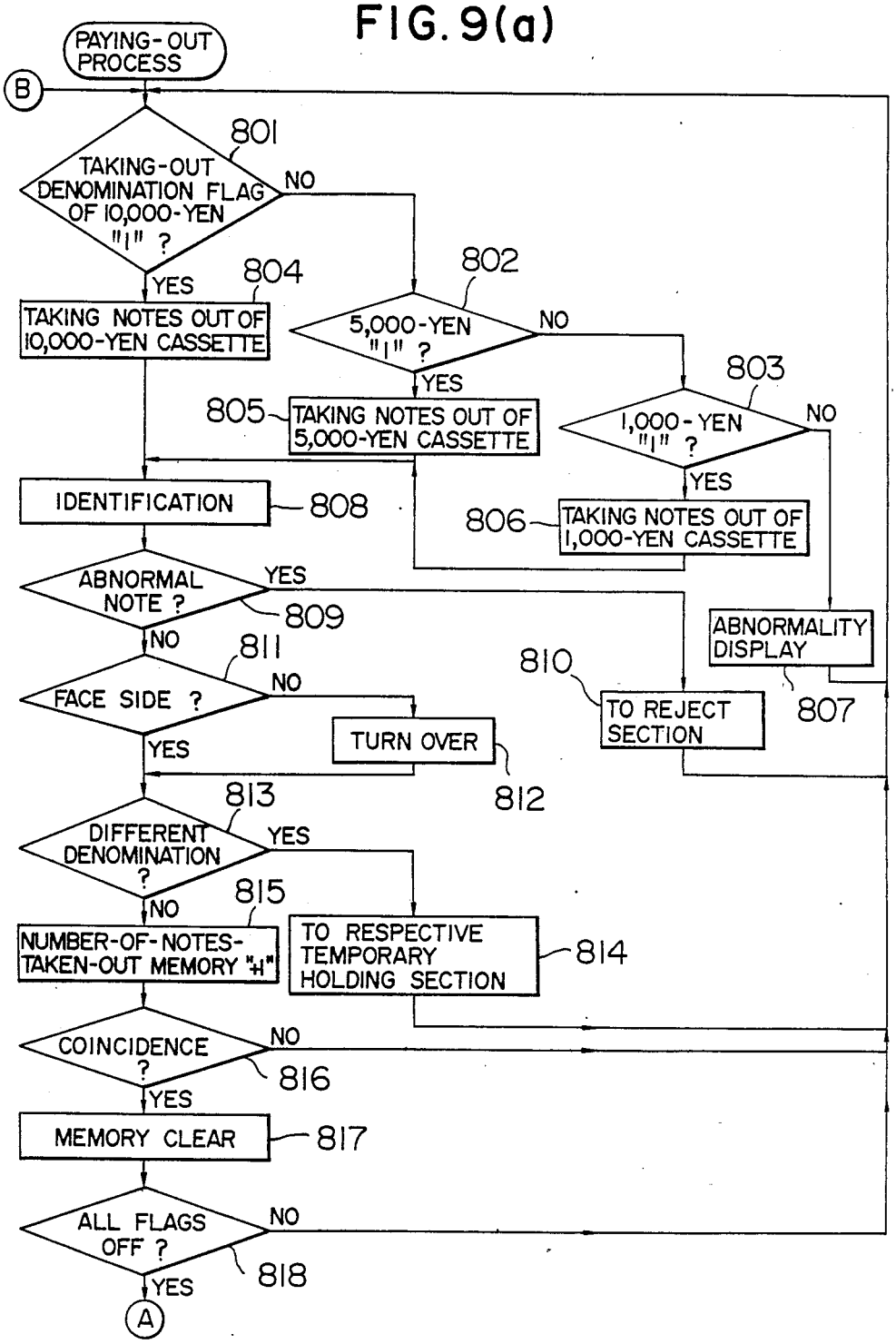

The parts (a) and (b) of FIG. 9 show a flow chart for the paying-out process. When the teller operates the operating section 407 of the teller's terminal machine, an amount of money to be paid (hereinafter referred to as "a paying-out money amount", when applicable) is stored in the paying-out money amount memory SKM in the part (a) of FIG. 6. Thereupon, the CPU 401 determines monetary denominations required for taking out notes and sets "1" in the taking-out denomination flags MFL, GFL and SFL in the part (b) of FIG. 6. At the same time, the CPU 401 determines the numbers of notes to be dispensed separately according to the monetary denominations. The numbers of notes thus determined are stored in the paying-out number-of-notes memories 10000SMM, 5000SMM and 1000SMM.

First, it is determined whether or not the flags of denominations are set to "1" in the order of "10,000-yen", "5,000-yen" and "1,000-yen" (Blocks 801, 802 and 803). For instance when the 10,000-yen flag MFL is "1", 10,000-yen notes are taken out. That is, the notes (10,000-yen) 102*a* in the first accommodating cassette section 302 are taken out by the taking-out mechanism so as to be delivered to the conveying path n one after another (Block 804). Similarly as in the case of 10,000-yen notes, 5,000-yen note and 1,000-yen notes are taken out (Blocks 805 and 806). When none of the taking-out denomination flags MFL, GFL and SFL are set to "1", the display section 407 of the teller's terminal machine indicates that the note is abnormal (Block 807).

The note thus taken out is delivered through the conveying paths o, p, q, r and b to the note identifying section 104, in which it is subjected to the low class identification (Block 808). When the note is detected to be abnormal (Block 809), it is delivered through the paths e, h, i, j and k to the reject section 301 (Block 810). When it is determined that the back side of the note faces upwardly (Block 811), the note is turned over by the note turning-over section 105 (Block 812). When the note is different in denomination (for instance when a note taken out of the first accommodating cassette section 302 is a 1,000-yen note) (Block 813), the note (1,000-yen) is sent to the respective temporary holding section (207) (Block 814).

When the note taken out is normal, one (+1) is added to the content of the number-of-notes-taken-out memory TMM in the part (a) of FIG. 6 (Block 815), and the note is sent to the note returning opening 107. The above-described operation is repeatedly carried out until the content of the paying-out number-of-notes 10000 SM coincides with that of the number-of-notes-taken-out memory TMM (Block 816). Upon coincidence, "0" is set in the 10,000-yen flag MFL, and the content of the memory TMM is cleared (Block 817).

Thereafter, it is determined whether or not the next denomination (5,000-yen or 1,000-yen) flag is set to "1". When it is determined that the next denomination flag is set to "1", notes of the next denomination are taken out (Block 818).

When all the notes have been taken out, the teller refers to the display section 407 of the teller's terminal machine 405 to confirm that the payment has been correctly carried out (Block 819) and operates the ending key. As a result, the notes held in the temporary holding sections 209 through 211 are received by the cassette sections 302 through 304, respectively (Block 820), and all the memories are reset (Block 821). In the case where the payment is not correct or it should be cancelled, the cancelling key of the operating section 406 is operated. As a result, the content of the number-of-notes-taken-out memory TMM is cleared (Block 823). At the same time, the notes dispensed are taken out by the teller, and are then collected through the note inserting opening 101 after the supplement mode is set (Block 822).

When it is required to dispense notes again, the teller set the memories again to repeat the above-described operations (Blocks 824 and 825).

Now, the supplement process will be described. The operations in the supplement process in which the supplement mode is specified and supplementing notes are inserted into the note inserting opening 101 are the same as those in the flow chart of FIG. 8 except that the operations in Blocks 706, 715 and 718 are omitted.

Other examples of the supplement process are as follows:

In the first example, the temporary holding unit 200 is pulled out of the body 100, and the teller puts notes in the temporary holding sections 205, 206 and 207 separately according to the monetary denominations. After the notes have been put in these temporary holding sections, the accommodating key of the operating section 406 is operated, so that the holding pieces 209, 210 and 211 are operated to cause the accommodating cassette sections 302, 303 and 304 to receive the respective notes.

In the second example of the supplement process, the accommodating unit 300 is pulled out of the body 100, and the teller puts notes in the accommodating cassette sections 302, 303 and 304 separately according to the monetary denominations.

In the third example of the supplement process, only the rejecting cassette section 305 is taken out of the accommodating unit 300 and notes different in denomination are collectively put in the rejecting cassette section 305. In this case, the notes should be separately delivered by the note taking-out mechanism 309 into the respective accommodating cassette sections 302, 303 and 304 after being subjected to the low class identification by the note identifying section 104.

Now, the collecting process will be described. When the teller specifies the collection mode by operating the operating section 406, first the note taking-out mechanism 308 operates to take notes (1,000-yen) 102*c* out of third accommodating cassette section 304. The notes thus taken out are delivered through the conveying paths l, m, n, o, p, q, r and b to the note identifying section 104. In the collection mode, the note identifying section 104 and the note turning-over section 105 are not operated, and therefore the notes are passed through these sections 104 and 105 and are then delivered through the conveying paths e, h, i, j and k to the rejecting cassetted section 305. After the third accommodating cassette section 304 has been empty, the notes in the second and the first accommodating cassette sections 303 and 302 are delivered to the rejecting cassette section 305 in the specified order. When the rejecting cassette section 305 has been filled up with the notes during the collection, the remaining notes are delivered into another accommodating cassette (for instance the first accommodating cassette section 302).

After the collection has been accomplished, the teller takes the rejecting cassette section 305 out of the accommodating unit 300 and inspects the notes carefully.

Another note collecting method may be employed in which the accommodating unit 300 is pulled out of the body 100 and the notes in the accommodating cassette sections 302 through 305 are checked carefully.

As is apparent from the above description, according to the invention, the money receiving path and the money paying path have the common path, and the mechanism for identifying at least the face and back sides of a note and the mechanism for turning over a note are provided in the common path. Therefore, in the circulation type automatic money receiving and paying machine according to the invention, the notes which are accommodated in the note accommodating sections or the notes which are dispensed as paying-out notes can be so set that the face or back sides thereof face in the predetermined direction. Thus, the teller's labor to arrange notes can be greatly released by the provision of the machine.

What is claimed is:

1. A circulation type automatic money receiving and paying machine for receiving and paying notes having a first side distinguishable from a second side on the reverse side thereof and edges, said machine comprising:

a first opening for receiving incoming notes;

a note accepting mechanism for successively accepting incoming notes inserted into said first opening;

a note accepting conveying path;

a note return conveying path;

the note accepting conveying path and the note return conveying path having a common conveying path;

note identifying means for identifying whether or not the incoming notes are false, a denomination of the notes, and the first and second sides of said notes;

a note turning-over section located downstream of said note identifying means, said section having a first conveying path for conveying notes identified by said note identifying means as having their first side facing in a predetermined direction, a second conveying path for conveying notes identified by said note identifying means as having their second side facing in said predetermined direction, the notes having said second side facing in said direction being turned over during conveying thereof by said conveying path, said first and second paths diverging at a junction located between said paths, a turning-over plate located at said junction, said plate being selectively movable to and from a position where it abuts on each of the leading edges of the notes conveyed successively through said note turning-over section, a roller located near said junction for transferring a note that has abutted said turning-over plate to said second path, said roller having vanes thereon, and a third conveying path located downstream of said first and second conveying paths, said first and second paths converging at said third conveying path, and third path passing correctly oriented notes;

temporary holding sections for temporarily holding turned-over notes in accordance with their monetary denominations;

cassette sections, downstream of said holding sections, for receiving notes temporarily held in said holding sections and accommodating the notes in a stack in accordance with their monetary denominations;

note releasing mechanisms, located downstream of said cassette sections, for successively releasing notes from said cassette sections in accordance with monetary denominations;

a released note conveying path for conveying notes released from said cassette sections;

the note common conveying path receiving incoming notes from said first opening, or released note conveyed by said released note conveying path;

a second opening for returning incoming false notes according to a discrimination of truth from falsehood by said note identifying means and for ejecting released notes;

the return conveying path conveying false notes and released notes from said note turning-over section to said second opening;

a distribution conveying path located downstream of said note turning-over section and between said note turning-over section and said temporary holding sections, said distribution conveying path distributing true notes from among incoming notes carried through said note turning-over section to said temporary holding sections according to the monetary denominations determined by said note identifying means; and a switch located between said third conveying path of said note turning-over section and said distribution conveying path and between said third conveying path and said return conveying path, said switch receiving notes from said third conveying path and switching notes carried through said note turning-over section to said return conveying path or to said distribution conveying path.

* * * * *